US005979097A

United States Patent [19]

Moore

[11] Patent Number: 5,979,097

[45] Date of Patent: Nov. 9, 1999

[54] TRADING CARD DISPLAY DEVICE AND METHOD

[76] Inventor: Danny E. Moore, 1713 Valley View, Van Buren, Ark. 72956

[21] Appl. No.: 08/942,649

[22] Filed: Oct. 2, 1997

Related U.S. Application Data

[63] Continuation of application No. 08/524,186, Sep. 6, 1995, abandoned.

[51] Int. Cl.[6] ..... G09F 1/12

[52] U.S. Cl. ..... 40/769; 40/717; 40/771; 40/124.03

[58] Field of Search ..... 40/124.03, 124.06, 40/455, 594, 661, 717, 725, 760, 761, 765, 768, 769, 771, 773, 775

[56] References Cited

U.S. PATENT DOCUMENTS

| | | | |
|---|---|---|---|
| D. 331,947 | 12/1992 | Blish et al. | D20/10 |
| D. 339,237 | 9/1993 | Korte | D6/300 |
| D. 340,880 | 11/1993 | Walton | D11/132 |
| D. 341,277 | 11/1993 | Smith, II | D6/472 |
| D. 346,829 | 5/1994 | Keefe | D20/40 |
| 1,068,621 | 7/1913 | Abraham | 40/765 X |
| 1,980,453 | 11/1934 | Tucker et al. | 40/768 X |
| 2,409,814 | 10/1946 | Vargish | 40/661 X |
| 3,691,312 | 9/1972 | Petersen . | |
| 3,857,191 | 12/1974 | Sadorus . | |
| 4,222,188 | 9/1980 | Tarrant et al. . | |
| 4,322,001 | 3/1982 | Hurley . | |
| 4,384,416 | 5/1983 | Kanzelberger | 40/773 X |
| 4,541,188 | 9/1985 | Sadorus . | |
| 4,611,262 | 9/1986 | Galloway et al. . | |
| 4,791,741 | 12/1988 | Kondo . | |
| 4,905,029 | 2/1990 | Kelley . | |
| 4,933,218 | 6/1990 | Longobardi . | |
| 4,989,353 | 2/1991 | Astolf | 40/761 |
| 5,011,072 | 4/1991 | Ludwig . | |
| 5,045,327 | 9/1991 | Tarlow et al. . | |
| 5,082,703 | 1/1992 | Longobardi . | |
| 5,087,145 | 2/1992 | Cooley . | |
| 5,106,126 | 4/1992 | Longobardi et al. . | |
| 5,121,563 | 6/1992 | Connor et al. | 40/661 |
| 5,133,450 | 7/1992 | Rademacher . | |
| 5,186,566 | 2/1993 | Cameron . | |
| 5,237,763 | 8/1993 | Ochoa . | |
| 5,263,576 | 11/1993 | Boreen et al. . | |
| 5,359,374 | 10/1994 | Schwartz . | |
| 5,365,686 | 11/1994 | Scott | 40/455 |
| 5,367,806 | 11/1994 | Hoffman | 40/594 X |
| 5,383,293 | 1/1995 | Royal | 40/768 |
| 5,461,810 | 10/1995 | Goserud | 40/771 X |
| 5,522,163 | 6/1996 | Neugebauer | 40/661 X |

*Primary Examiner*—Brian K. Green
*Attorney, Agent, or Firm*—Head, Johnson & Kachigian

[57] ABSTRACT

A display device, kit, system and method is provided which utilizes an item holder in combination with an angled frame to provide a protective, aesthetically pleasing, versatile display of one or more items such as trading cards, sports cards, racing cards, photographs, greeting cards, prints, and the like. In accordance with an exemplary embodiment, the display device includes a substantially rectangular, transparent, trading card holder attached to the back surface of an angled frame, a primary mat adapted to be placed adjacent one surface of the frame and to serve as a mat in association with the front of the trading card being viewed through the frame, and a secondary mat adapted to be placed adjacent one surface of the item holder and to serve as a mat in association with the back side of the trading card being viewed through the item holder. In accordance with another example, the display device further includes a sound emitting device attached to the frame. In accordance with still another example, the display device further includes a sound emitting and recording device attached to the frame. The first and second mats or borders and the sound emitting or sound emitting and recording devices add to the enjoyment of and enhance the viewing experience of viewing the item or items retained in the item holder by having colors, graphics, text, pictures, sounds, speech, and the like which compliment, personalize, or relate in some way to the item being displayed.

20 Claims, 4 Drawing Sheets

TRADING CARD DISPLAY DEVICE AND METHOD

CROSS REFERENCE TO RELATED APPLICATIONS

This application is a continuation of U.S. patent application Ser. No. 08/524,186, filed Sep. 6, 1995, now abandoned.

BACKGROUND OF THE INVENTION

The present invention is directed to display devices and more particularly concerns a display device, system, and method for displaying one or more items such as trading cards, photographs, greeting cards, and the like, utilizing a protective item holder and a frame. The display device of the present invention can provide an aesthetically pleasing, and protective display for items including valuable, historic, sentimental, rare or fragile trading cards, photographs, prints, and the like.

Typically, valuable sports trading cards such as historic or rare baseball cards are kept in substantially rectangular, transparent, rigid, protective trading card holders, including front and back panels of lucite or other transparent material releasably joined together by a threaded fastener in each corner. These rigid transparent trading card holders protect the enclosed trading card from finger prints, moisture, mutilation or mangling during display, transport, or the like.

Such a conventional, rectangular trading card holder is used to display the trading card by placing the card in the holder and laying the holder on its back on a flat surface. A conventional 3"×5"×¼" sports trading card holder is not able to stand vertically on end or on its side edge. A thicker sports card holder having dimensions of 3½"×5¾"×1" can be stood on edge or on end but is unstable and may fall with a slight jarring of the holder or supporting surface. Attempts have been made to increase the stability of the holder by adding a heavy base.

U.S. Pat. Nos. 4,322,001, 5,121,563, and 5,133,450 disclose other types of sports card holders made of transparent materials which provide some protection for the enclosed card. U.S. Pat. No. 5,121,563 further discloses the addition of a flexible, V-shaped, detachable support member which clamps to the sides of the card holder and extends rearwardly therefrom to provide an upright or angled positioning of the holder. Again, this embodiment suffers from the drawback of being unstable, in that the contact point of the V-shaped support with a planar surface is near the apex of the support which allows the display holder to topple sidewardly given a jarring of the planar surface or of the display holder.

Further, U.S. Pat. No. Des. 339,237, U.S. Pat. No. Des. 341,277, U.S. Pat. Nos. 5,237,763, and 5,263,567 disclose other baseball or trading card display devices.

Hence, there is a need for an improved display device, system and method for displaying items such as trading cards, including sports cards, racing cards, and other collecting cards, photographs, prints, drawings, and the like, and which provides an aesthetically pleasing, versatile, stable, angled, and/or protective display of such items.

SUMMARY OF THE INVENTION

In accordance with the present invention, a display device system and method is provided which utilizes a item holder in combination with an angled frame to provide a protective, aesthetically pleasing, versatile, display of one or more items such as trading or collecting cards, sports cards, racing cards, photographs, greeting cards, prints, and the like.

In accordance with an exemplary embodiment of the present invention, a trading card display device includes a substantially rectangular, transparent, trading card holder attached to the back surface of an angled frame, a primary mat adapted to be placed adjacent one surface of the frame and to serve as a mat in association with a front side of a trading card in the holder and being viewed through the frame, and a secondary mat adapted to be placed adjacent one surface of the item holder and to serve as a mat in association with a back side of the trading card being viewed through the item holder.

In accordance with a particular example of the present invention, the item holder is made of first and second panels of a clear or transparent, sturdy material such as lucite or plexiglas, has an outer dimension larger than that of the trading card to be held therein, and the panels are secured one to another by a plurality of threaded fasteners. The frame is an integral or unitary item having front, back and base panels formed of a clear or transparent material such as plastic or resin, for example, plexiglas and is suited to hold a mat or border between the front and rear panels. The base panel is adapted to sit upon a flat horizontal surface, and to support the front and back panels in an upwardly angled position. The item holder is attached to the back surface of the back panel by, for example, upper and lower sections of adhesive, joining, or coupling materials such as double-sided tape. A first mat has outer dimensions corresponding to the outer dimensions of the front panel of the frame and at least one central viewing aperture or opening having dimensions less than or equal to the outer dimensions of the trading card held in the item holder. A second mat has outer dimensions corresponding to the outer dimensions of the item holder and includes at least one central viewing aperture sized less than or equal to the outer dimensions of the trading card secured in the item holder.

In accordance with another example of the present invention, the display device further includes a sound emitting device attached to the base of the frame.

In accordance with still another example of the present invention, the display device further includes a sound emitting and recording device attached to the base of the frame.

In accordance with the present invention, an upstanding display, one or more mats or borders, and one or more sound emitting or sound emitting and recording devices add to the enjoyment and enhance the viewing experience of viewing the item retained in the item holder by having colors, graphics, text, pictures, sounds, speech, and the like which relate in some way to the item being displayed. For example, if a baseball trading card is displayed, the primary and secondary mats or borders may include the team colors, team logo, name of the player, quote by the player, baseball items such as balls, bats, pennants, caps, and a sound emitting device may have the sounds familiar with a baseball stadium, baseball game event, a quote by a famous player, old recordings from radio or television, for example, of Babe Ruth or Lou Gehrig, historic moments in sports, or a personalized message from a player.

In accordance with another exemplary embodiment of the present invention, a display kit or system includes a protective item holder, a transparent frame, elements for attaching the holder to the frame, primary and secondary mats, and may also include a sound emitting or sound emitting and recording device.

In accordance with yet another exemplary embodiment of the present invention, a trading card display assembly includes a trading card, a primary mat, and a secondary mat, with the mats having colors, graphics, text, pictures, emblems, logos, or the like, relating in some fashion to the trading card.

In accordance with still yet another exemplary embodiment of the present invention, a display assembly for use in connection with the display device of the present invention, includes a primary mat, a secondary mat, and a sound emitting and/or recording device. In accordance with a particular example of the present invention, these items are found on a single piece of card stock and separated by perforations therebetween.

The principal object of the present invention is the provision of a display device which is relatively inexpensive to manufacture, simple in construction, easy to utilize, versatile, provides protection for the displayed item, and presents an aesthetically pleasing and enhanced viewing experience.

Another object of the present invention is the provision of a display device, system, kit, assembly, and method, which utilizes a transparent holder and an angled transparent display frame with the holder attached to the back surface of the frame.

A still further object of the present invention is the provision of a display device system, kit, assembly and method which includes not only a protective item holder, a transparent angled frame, but also primary and secondary mats.

Still yet another object of the present invention is the provision of a trading card display kit, including a protective card holder, a transparent frame, a primary mat, a secondary mat, elements for attaching the holder to the frame, a sound emitting device, and/or a sound emitting and recording device.

Another object of the present invention is the provision of a display assembly including a primary mat, a secondary mat, a sound emitting device, a sound emitting and recording device, and/or a trading card.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 2:
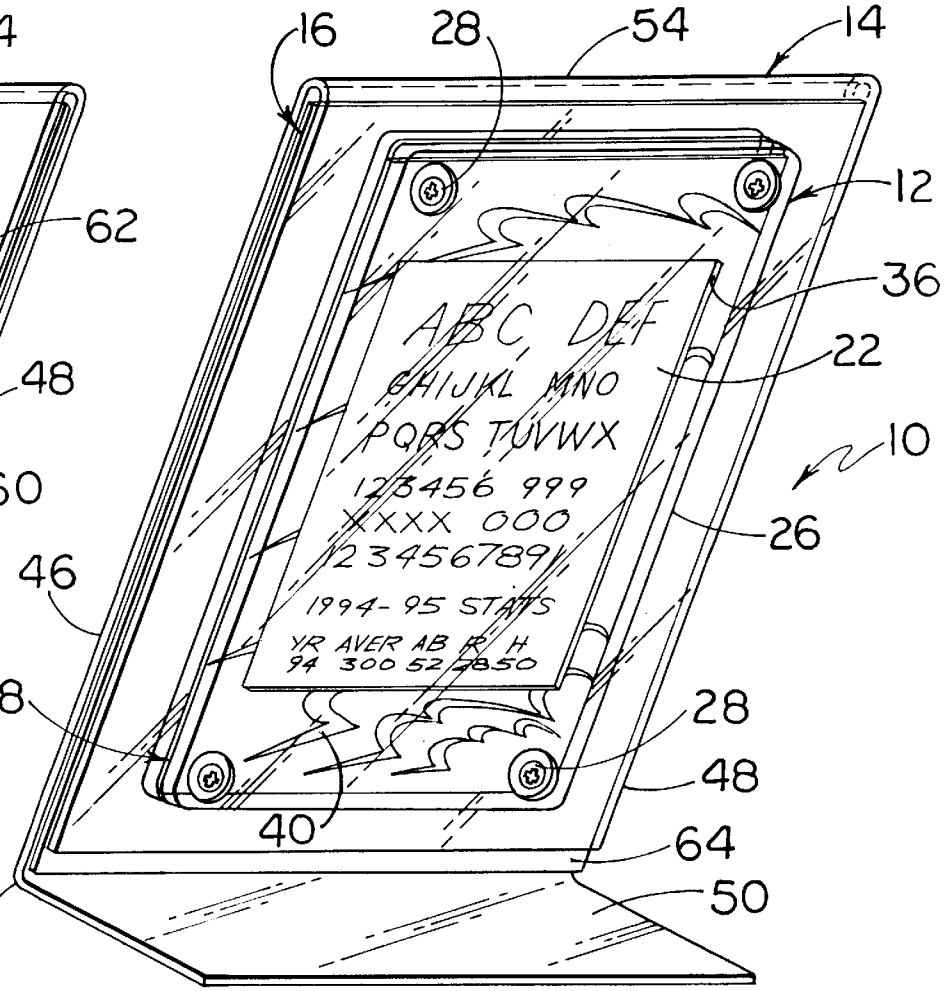
FIG. 2 is a rear perspective view representation of the display device of FIG. 1.
Figure 1:
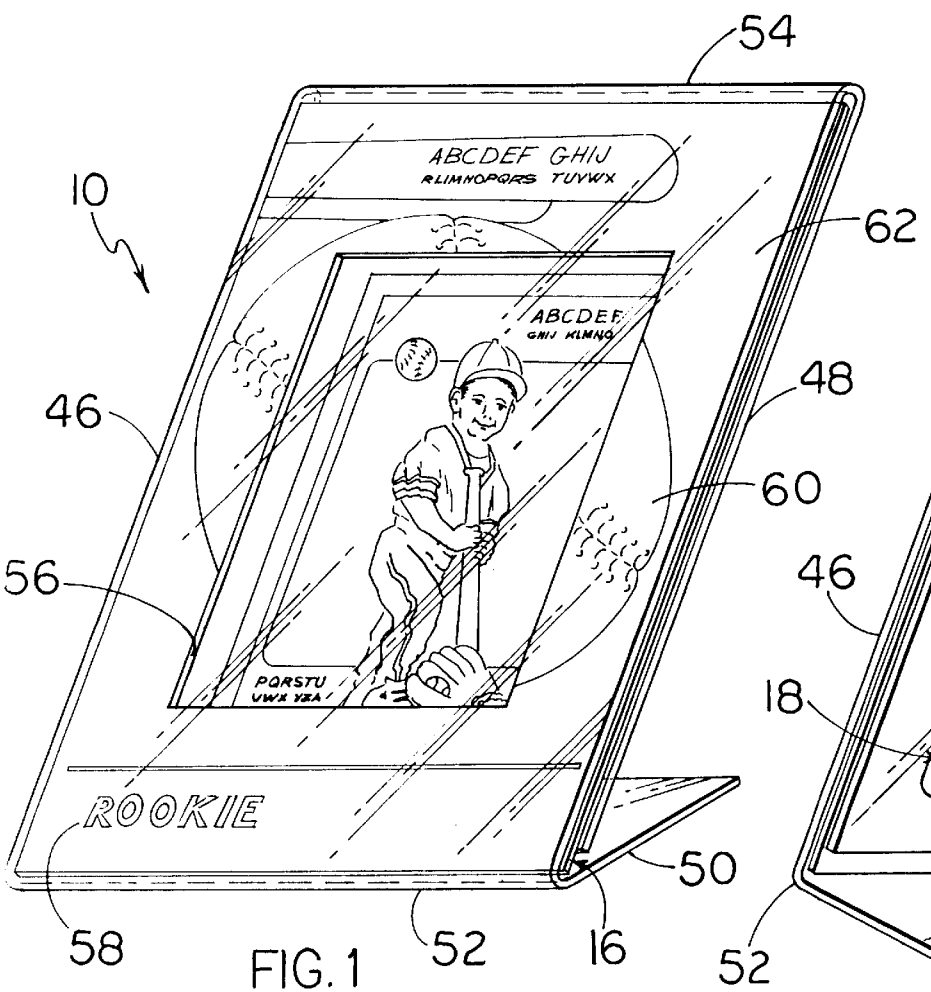
FIG. 1 is a front perspective view illustration of a display device, kit or system in accordance with an exemplary embodiment of the present invention.
Figure 3:
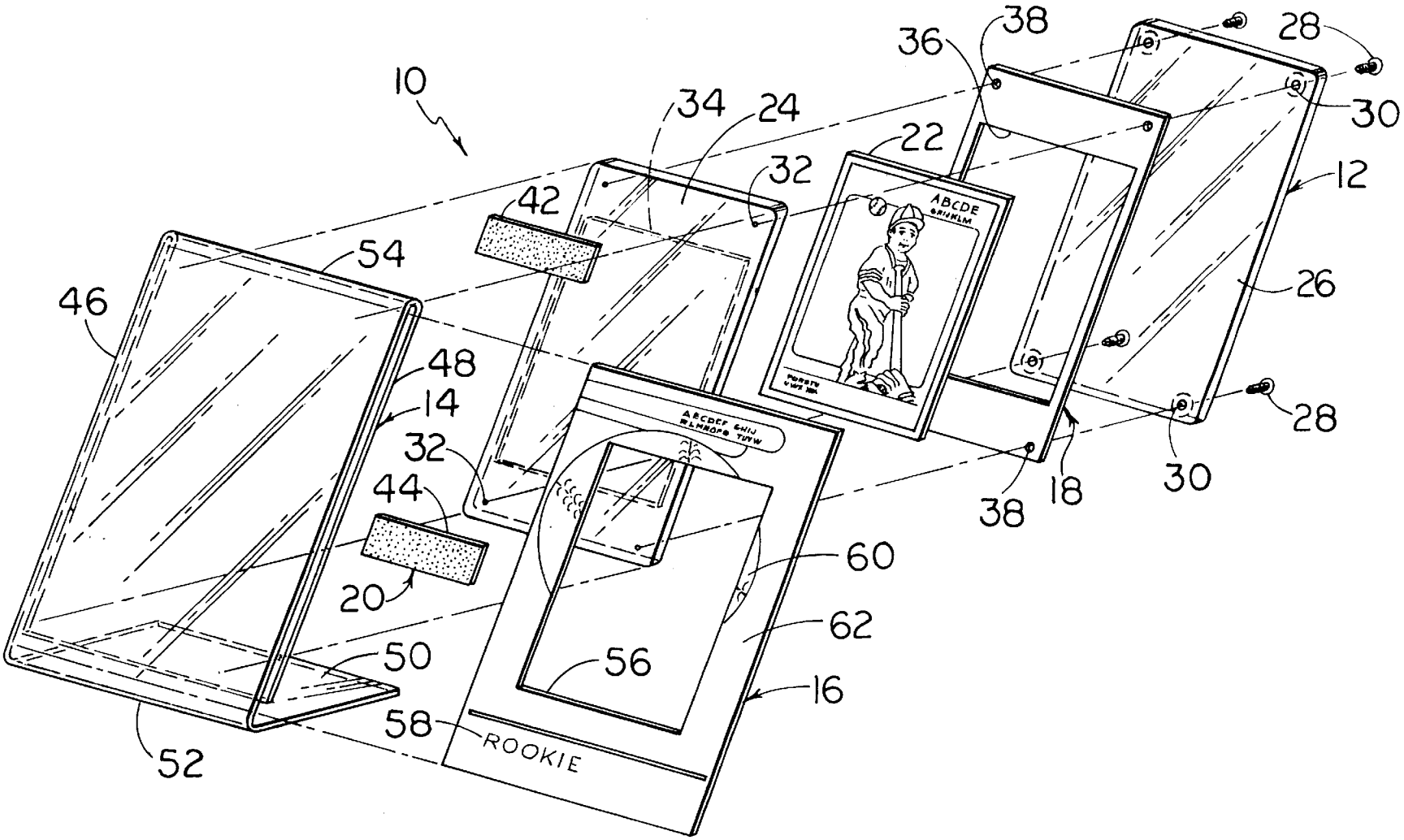
FIG. 3 is an exploded view illustration of the display device of FIG. 1 with the parts separated to show the relationship or order of assembly of the various parts thereof.

In accordance with an exemplary embodiment of the present invention as shown in FIGS. 1, 2 and 3 of the drawings, a display device, kit or system generally designated by the reference numeral 10 includes as major components an item holder 12, a frame 14, a primary mat 16, a secondary mat 18, means 20 for attaching the holder to the frame, and an item 22 such as a trading card, picture, print, sports card, or the like.

The item holder 12 is shown to have a conventional construction including transparent, substantially rectangular, front and rear panels 24 and 26 releasably coupled, joined, or connected to one another by a plurality of threaded fasteners 28, each received within a corresponding cylindrical opening 30 in back panel 26 and a corresponding threaded opening 32 in front panel 24. Front panel 24 also includes a rectangular recess 34 on the rear surface thereof for receiving the item 22. Item holder 12 is designed to safely retain, house, enclose, support, exhibit, and display a planar item such as a trading card, photograph, print, greeting card, sports card, baseball card, racing card, and the like, therein. The front and rear panels 24 and 26 prevent the item 22 from being bent, mutilated, touched, stained, etc., and thereby tend to preserve the item.

If one desires to have a substantially airtight seal between front and rear panels 24 and 26 of item holder 12, with both an item 22 and secondary mat 18 sandwiched therebetween, the outer dimension of secondary mat 18 is reduced slightly from that shown and a rectangular recess adapted to receive the secondary mat 18 is added to the forward surface of rear panel 26 so that the back surface of front panel 24 and the forward surface of rear panel 26 can be brought together along the outer edges thereof.

Although item holder 12 is shown to enclose or retain both the item 22 and secondary mat 18, it is contemplated that the item holder 12 can be used without secondary mat 18 or with both secondary mat 18 and a tertiary mat or border located in front of the item 22. Further, although the item holder 12 is shown enclosing, retaining, and displaying only a single item 22, it is to be understood that a plurality of items may be displayed, for example, by enlarging the frame to accommodate a number of holders or enlarging the holder and modifying the secondary and/or tertiary mats or borders to include a corresponding number of viewing openings or apertures therein for viewing a selective portion of each of the retained items.

In accordance with a particular example of the present invention, the item holder 12 is formed of transparent, rigid, lucite front and rear panels, each having an outer dimension of about 3"×5⅛"×⅛", the item 22 is a sports trading card having outer dimensions of about 2½"×3½", the secondary mat 18 has outer dimensions of about 3"×5" and is made of a thin paper stock with a minimal thickness and has a viewing opening or aperture 36 sized about 2½"×3½" and a plurality of circular openings 38 for accommodating each of the screws 28.

Figure 7:
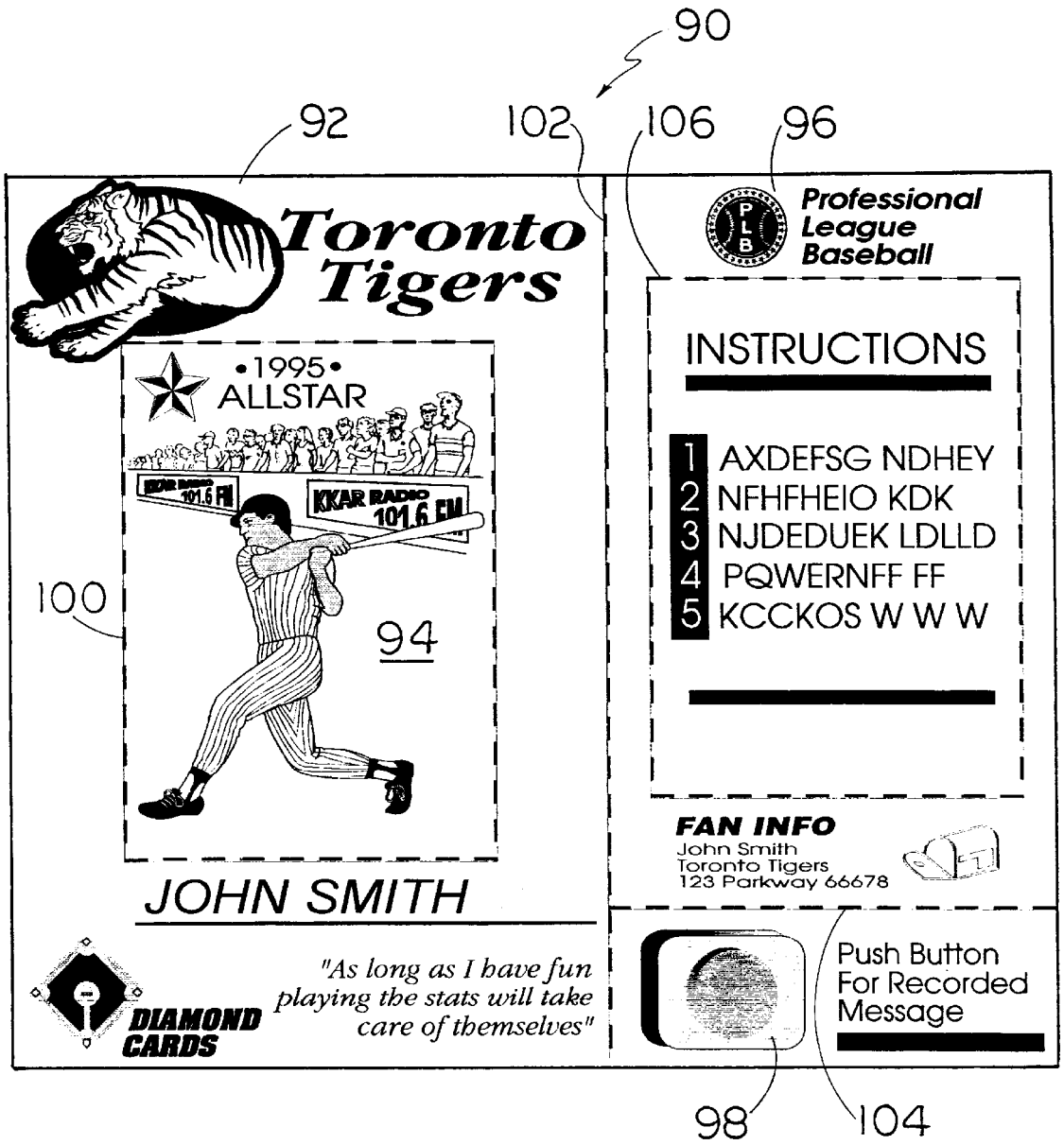
FIG. 7 is a front plan view illustration of a display assembly in accordance with still yet another exemplary embodiment of the present invention.

Screws 28 can be formed of any sturdy, resin or metal material, such as stainless steel, and can be brass, gold, or chrome plated to provide a stylish look to the display device 10. The front and/or rear surfaces of secondary mat 18 can be colored, include text, designs, graphics, logos, and the like, to provide an aesthetically pleasing appearance, to personalize the display, and/or compliment the item or items being displayed. In accordance with the present invention, a trading card, primary mat, secondary mat, tertiary mat, sound box, and/or sound recording and play back device may be marketed together as an assembly and have colors, designs, logos, text, insignias, portraits, etc. which compliment one another and enhance the display and viewing experience (FIG. 7).

With respect to the exemplary embodiment shown in FIGS. 1–3 of the drawings, the frame 14 is formed of a single piece of transparent, plastic or resin material such as plexiglas which is molded, bent, formed, or shaped into the shown configuration. The frame 14 has a horizontal base or pedestal 50, a first bend 52, a front panel 46 angling upwardly from the base 50 at an acute angle, a second bend 54, and a rear or back panel 48 extending downwardly and substantially parallel to front panel 46. Front and rear panels 46 and 48 define a gap therebetween sufficient to receive primary mat 16 therein.

In accordance with a particular example the present invention, the frame 14 is made from an approximately 4 inch wide length of 1/16 inch thick transparent or clear plexiglas bent or formed so as to have a base with a width of about 4 inches and a length of 2 or more inches, a front panel with a width of about 4 inches and a height of about 6 inches, and a back panel with a width of about 4 inches, and a length of about 5½ inches. Also in accordance with this particular example, the primary mat 16 has outer dimensions of about 4"×6", a viewing opening or aperture 56 of about 2½"×3½" and is made from heavy paper stock or card stock material with text 58, logos, designs, images 60, colors, and/or the like, on front surface 62 and/or rear surface 64 thereof. It is preferred that the front panel 46 extend at an acute angle of about 65° to 70° from base 50.

Conventional off-the-shelf transparent bent plexiglas picture frames are not well suited for use as the frame 14 in the display device 10 of the present invention since the attachment of a relatively heavy item holder 12 to the back surface of the frame 14 tends to cause conventional pictures frames to topple over because their bases are not large enough, and their display angle is not small enough. Also, the back panel of conventional frames is too short to accommodate the attachment of the item holder both above and below the displayed item. Hence, it is preferred that the frame 14 of the present invention differs from conventional picture frames and includes an elongate base having a length of at least 3/10 of the height of the front panel, front and rear panels angled at an acute angle of less than 80° with respect to the base, and a back panel 48 which extends almost the entire length of front panel 46.

In the exemplary embodiment shown in FIGS. 1–3 of the drawings, the item holder 12 is attached to the frame 14 via upper and lower sections or lengths 42 and 44 of adhesive material such as 3M brand double-sided tape attached to the forward surface of holder panel 24 and the rearward surface of frame panel 48 above and below the item receiving recess 34 so as not to obstruct the view of the item 22. Item holder 12 may be permanently attached to the back of frame 14 using glue, solvents, adhesives, heat sealing, sonic welding, or the like, in a manner which does not obstruct the view of the item 22 through the frame 14 or panel 24. Also, in accordance with the present invention, it is contemplated that the item holder 12 may be releasably attached to frame 14, for example, using VELCRO brand hook and loop fastening tapes, reusable adhesives, or one or more threaded fasteners which penetrate through item holder 12 and into the back panel 48 of frame 14.

Although it is preferred that item holder 12 include both front and rear panels 24 and 26, it is to be understood that front panel 24 and attaching means 20 may be eliminated, for example, by modifying the back panel 48 of frame 14 to include the item receiving recess 34, and threaded openings 32 so that the item 22 is placed directly against the back panel of frame 14, followed by secondary mat 18 and rear panel 26 and held in position by having threaded fasteners 28 pass through openings 30 in rear panel 26, openings 38 in secondary mat 18, and into threaded openings in the back panel of frame 14.

Although the primary and secondary mats or borders 16 and 18 are shown as separate items in the display device 10, it is contemplated that the primary mat 16 may be incorporated into the frame, for example, by being screen printed onto the front or rear surface of front panel 46 of the frame 14, or the frame 14 may be constructed of a single angled panel of an opaque material with an opening or aperture for viewing of the item therethrough. Likewise, the secondary mat 18 may be incorporated into the item holder, for example, by being screen printed onto one surface of the back panel 26 of the holder 12, or the back panel 26 may be formed of an opaque material having an aperture or opening therein for viewing the retained item. It is preferred that the item holder 12 have continuous, solid, rigid or semi-rigid front and rear panels to provide protection to a valuable trading card, sentimental photograph, or other item retained in the item holder.

In accordance with another example of the present invention, a frame adapted to display an item having a horizontal rather than vertical picture or graphic, such as a racing card showing a particular race car thereon, is made from an approximately 6 inch wide length of 1/16 inch thick transparent plexiglas bent to have a base panel with a width of about 6 inches and a length of 1½ inches or more, a front panel with a width of about 6 inches and a height of about 4 inches, and a back panel with a width of about 6 inches and a length of about 3¾ inches. Also in accordance with this example, the primary mat has height and width dimensions of about 4"×6", a viewing opening or aperture of about 2½"×3½", and has text, logos, designs, images, colors, or the like, oriented for a horizontal presentation. It is preferred that the front panel extend at an acute angle of about 80° or less from the base. Also in accordance with this example, the holder can be attached to the back of the frame via double-sided adhesive tape placed to the right and left of the viewing opening and the holder oriented with its long dimension horizontal to display the item horizontally.

Trading cards, for example sports cards, sometimes cost in excess of $60.00 per card for promotional cards, or special limited edition cards. Also, rare, autographed, single cards can be worth $500.00 and up. Card collectors, novices, or those who receive valuable cards as gifts, need a way of displaying these cards in an aesthetically pleasing arrangement, while at the same time protecting the card from damage by having a stable and durable display. Also, children who have heroes in sports and other fields of interest need a display device which is aesthetically pleasing to them as well as providing a protective display for the card or item. The display device, kit, system and method of the present invention provide a free-standing, easy to see, protective display with a graphic and/or color designed border or borders which compliment the card or personalize the entire display, which is especially suited to please children, and useful as gifts.

In order to make a trading card or displayed item or items even more valuable or more desirable, one or more sound emitting devices or sound emitting and recording devices are attached to the frame or holder. For example, an autographed or limited edition card is enhanced in accordance with the present invention by having a recorded message from the person depicted on the trading card, or sounds of the event depicted on the trading card. Also, it is contemplated that the recorded message and the primary and/or secondary mats may be coordinated and compliment one another as well as the trading card or item being displayed to further enhance the enjoyment and overall experience of viewing the displayed item or items.

Figure 4:
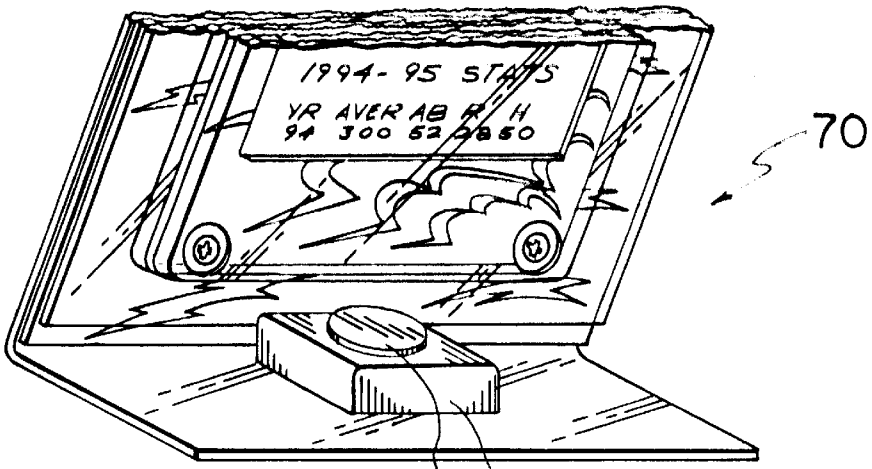
FIG. 4 is partial rear perspective view representation of a display device, kit or system in accordance with another exemplary embodiment of the present invention.

In accordance with another exemplary embodiment of the present invention as shown in FIG. 4 of the drawings, a display device, kit or system generally designated by the reference numeral 70 includes an item holder, frame, primary and secondary mats, an item identical to that disclosed in the embodiment of FIGS. 1–3 of the is drawings, with the exception of the addition of graphics to the back of the primary mat 16 and of a sound box, sound emitting device, circuit, music box, or the like 72 attached to the top surface of the base panel of the frame. In this position, the sound emitting device 72 is hidden from view when viewing the displayed item from the front of the display device 70. The sound emitting device includes an on switch or activation button 74 which activates the sound emitting device 72 so as to cause it to emit the prerecorded sound, message, etc. Such sound emitting devices are disclosed in U.S. Pat. No. 4,611,262 issued Sep. 9, 1986 to Galloway, et al., and U.S. Pat. No. 4,791,741 issued Dec. 20, 1988 to Kondo, each hereby incorporated by reference. These patents are directed to electrical circuits for greeting cards and the like, which will play a tune when activated. It is contemplated that the sound emitting device 72 could have the prerecorded tune of "Take Me Out to the Ball Park", thereon, which would compliment the display of a baseball, little league, t-ball, trading card or photograph.

Further, U.S. Pat. No. 4,791,741 not only discloses a device which plays a tune or message, but also allows for the recording of a tune or message. In accordance with the present invention, it is contemplated that a sound emitting and recording device can be substituted for the device 72 and be used to not only play a message, but also have the capability of recording a message so that the user may, for example, personalize the tune or message, or change the tune or message emitted when the displayed item is changed.

In accordance with a particular example of the present invention, the sound emitting device 72 emits sounds associated with a race car racing event upon activation or depression of button 74, and compliments the display of a racing card enclosed in the item holder attached to the frame of the display device 70.

Figure 6:
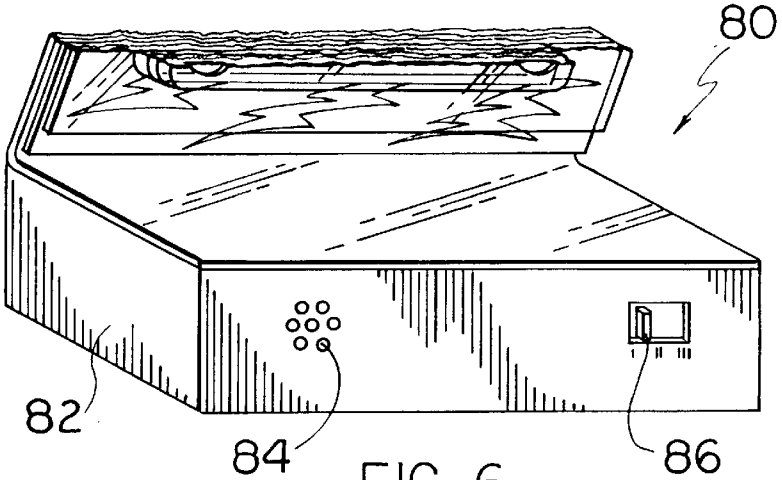
FIG. 6 is a rear perspective view representation of the display device of FIG. 5.
Figure 5:
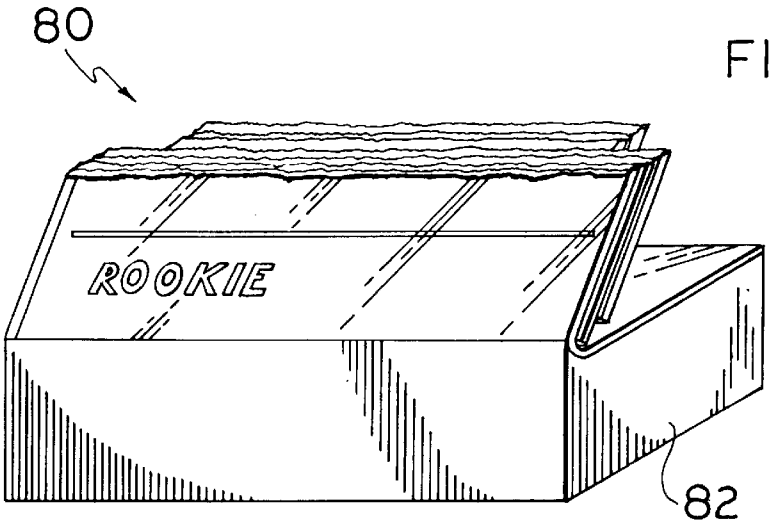
FIG. 5 is a partial front perspective view illustration of a display device, kit or system in accordance with yet another exemplary embodiment of the present invention.

In accordance with yet another exemplary embodiment of the present invention as shown in FIGS. 5 and 6 of the drawings, a display device, kit or system generally designated by the reference numeral 80 includes an item holder, frame, primary and secondary mats and a displayed item identical to the display device 10 shown in FIGS. 1–3 of the drawings, with the exception of the addition of graphics to the back of the primary mat and of a rectangular base enclosure 82 attached to the lower surface of the base panel of the frame. The enclosure 82 houses a sound emitting and recording device for augmenting the enjoyment and overall viewing experience of viewing the displayed item. The base enclosure 82 includes a plurality of small openings 84 which allow for the travel of sound into the enclosure to a microphone, and a multiposition switch 86 having off, play, and record positions indicated as I, II, and III. Again, U.S. Pat. No. 4,791,741 discloses a record/playback device for use in a greeting card and is hereby incorporated by reference. The device disclosed in U.S. Pat. No. 4,791,741 may be modified or reconfigured to fit within the base enclosure 82 and add to the enjoyment of the viewing experience by allowing the user to personalize the sounds, tunes, or message complimenting or relating to the displayed item or items. Having the ability to rerecord the sound, tune or message also allows the user to change the displayed item or items, and again personalize or compliment the newly displayed item or items.

In accordance with a particular example of the present invention, a sound emitting and recording device of a type found in a HALLMARK brand greeting card is placed in a base enclosure 82 attached to the lower surface of the base panel of a bent plexiglas frame, and a part of a speech of a particular sports player is recorded thereon, and a sports card depicting that player is placed in the item holder and displayed by the device.

In accordance with the present invention, it is contemplated that the sound emitting device 72 and the sound emitting and recording device located in the closure 82 are battery operated, and either provide for replacement of the battery or are themselves disposable, replaceable, and the like. It is to be understood that although a single device 72 is shown attached to the frame in FIG. 4 of the drawings, one or more of the devices as desired may be attached to the frame and/or holder and used to compliment, enhance, or personalize the displayed item or items.

U.S. Pat. No. 3,857,191 issued Dec. 31, 1974 to Sedoras; U.S. Pat. No. 4,222,188 issued Sep. 16, 1980 to Tarrant, et al.; U.S. Pat. No. 4,541,188 issued Sep. 17, 1985 to Sedoras; U.S. Pat. No. 5,045,327 issued Sep. 3, 1991, to Tarlow, et al.; and U.S. Pat. No. 5,359,374 issued Oct. 25, 1994, to Schwartz disclose sound emitting and/or recording devices for use with picture frames and are each hereby incorporated by reference.

In accordance with still yet another embodiment of the present invention as shown in FIG. 7 of the drawings, one or more of the components of the display devices, kits, or systems 10, 70, or 80 may be combined and marketed as a display assembly or card assembly generally designated by the reference numeral 90, including a primary mat 92, a trading card 94, a secondary mat 96, and a sound emitting device 98. The primary mat 92 and trading card 94 are joined along a rectangular perforation line 100. The secondary mat 96 and sound emitting device 98 are joined to the primary mat 92 via a vertical perforation line 102. The secondary mat 96 and sound emitting device 98 are separated by horizontal perforation line 104. Lastly, the central or viewing opening of the secondary mat 96 is separated from, for example, instructions for use of the display assembly by a rectangular perforation 106. The components are easily separated from one another merely by bending the assembly along the perforation 102 and tearing the secondary mat 96 and sound emitting device 98 away from the primary mat 92, bending the secondary mat and sound emitting device subassembly along perforation 104 and tearing those components away from one another, pushing the instructions out of the center of the secondary mat 96, and lastly pushing the trading card 94 out of the center area of primary mat 92.

Such a display or card assembly 90 may be sold together with or separately from the item holder and frame shown, for example, in FIGS. 1–3 of the drawings. Although FIG. 7 of the drawings shows a display or card assembly 90 having a vertical orientation to the trading card and primary and secondary mats, it is contemplated that a similar display or card assembly having a horizontal orientation to the trading card and mats or having a plurality of trading cards or other items can be made with perforations between the different components.

In accordance with a particular example of the present invention, a display assembly 90 is made from a heavy, high quality card stock having color printing on both the front and rear surfaces thereof, a sports trading card autographed by a particular sports player, primary and secondary mats complimenting the trading card, and a sound emitting device which plays a message from the particular sports figure shown in the trading card when activated.

Thus, it will be appreciated that as a result of the present invention, a highly effective, improved, display device, kit, system, assembly, frame, and method is provided by which the principal objective among others is completely fulfilled. It is contemplated, and will be apparent to those skilled in the art from the preceding description and accompanying drawings, that modifications and/or changes may be made in the illustrated embodiments without departure from the present invention. For example, the display device may be used to display a rare, or valuable coin or coins, or other element of monetary exchange using an item holder particularly adapted for such item or items. Accordingly, it is expressly intended that the foregoing description and accompanying drawings are illustrative of preferred embodiments only, not limiting, and that the true spirit and scope of the present invention be determined by reference to the appended claims.

What is claimed is:

1. A protective display device for housing and displaying at least a portion of front and rear of one or more trading cards or sports cards, comprising:

a card holder having front and rear panels adapted to hold at least one card therebetween, each of said front and rear panels of said card holder having at least one transparent area providing for viewing of at least a portion of one side of the card therethrough, and a frame having front, rear and base panels formed as a unitary item and at least one transparent card viewing region in each of said front and rear panels for viewing at least a portion of said card therethrough, said holder being attached to a rear surface of said rear frame panel to provide for viewing of at least a portion of one side of said card through said viewing region, and said base panel supporting said frame and said holder in a stable, substantially upright position.

2. The device as recited in claim 1 further comprising a primary mat adapted to be placed adjacent one surface of said front panel of said frame and having at least one opening dimensioned to provide for viewing of at least a portion of one side of said card therethrough.

3. The device as recited in claim 2 further comprising a secondary mat adapted to be placed adjacent one surface of said holder and having at least one opening dimensioned to provide for viewing of at least a portion of one side of said card therethrough.

4. The device as recited in claim 3 wherein said front and rear panels of said holder are transparent and releasably joined by a plurality of threaded fasteners.

5. The device as recited in claim 3 wherein said primary mat is placed between said front and rear panels of said frame and said secondary mat is placed between said front and rear panels of said holder.

6. The device as recited in claim 1 further comprising a secondary mat adapted to be placed adjacent one surface of said holder and having at least one opening dimensioned to provide for viewing of at least a portion of one side of said card therethrough.

7. The device as recited in claim 1 further comprising a sound emitting device attached to said frame.

8. The device as recited in claim 1 further comprising a sound recording device attached to said frame.

9. The device as recited in claim 1 further comprising a sound emitting and recording device attached to said frame.

10. The device as recited in claim 1 wherein said front, rear and base panels of said frame are transparent.

11. The device as recited in claim 1, wherein the base panel of said frame has a length of at least 3/10 of the height of the front panel, the front panel has an acute angle of less than 80° with respect to the base panel, and the back panel has at least 9/10 of the length of the front panel.

12. The device as recited in claim 1, further comprising:

an integral, separable assembly of at least one card together with a primary mat, a secondary mat, and a sound box.

13. The device as recited in claim 1 wherein said front and rear panels of said holder are transparent.

14. A method of displaying at least a portion of front and rear surfaces of a trading card or a sports card, comprising the steps of:

placing a card in a card holder having front and rear panels, each of said front and rear panels having at least a transparent area providing for viewing of at least a portion of one side of said card therethrough, and attaching said card holder to a frame having front, rear and base panels formed as a unitary item and at least one item viewing region in each of said front and rear panels for viewing at least a portion of said card therethrough, said card holder being attached to a rear surface of said rear panel to provide for viewing of at least a portion of one side of said card through said item viewing region.

15. A display device kit comprising:

an item holder having transparent front and rear panels adapted to releasably hold a planar item therebetween, a transparent frame having front, rear and base panels formed as a unitary piece and at least one item viewing region in each of said front and rear panels for viewing at least a portion of the item therethrough, said front panel of said item holder being attached to a rear surface of said rear panel of said transparent frame to provide for viewing of at least a portion of one side of the item through said item viewing region and at least a portion of another side of the item through said rear panel of said item holder, and means for securing said item holder to a rear surface of said frame.

16. The kit as recited in claim 15 further comprising a mat.

17. The display device kit as recited in claim 15 further comprising:

an integral, separable assembly of at least one item, a primary mat, and a secondary mat adapted for use in the display device kit.

18. A method of displaying at least a portion of front and rear surfaces of a planar item such as a trading card comprising the steps of:

placing an item in an item holder having front and rear panels, each of said front and rear panels having at least one transparent area providing for viewing of at least a portion of one side of the item therethrough, and attaching said item holder to the back of a frame having front, rear and base panels formed as a unitary item and at least one item viewing region in said front and rear panels for viewing at least a portion of the item therethrough, attaching said item holder to a rear surface of said rear frame panel to provide for viewing of at least a portion of one side of the item through said item viewing region, and placing a primary mat in said frame.

19. The method of claim 18 further comprising the steps of:

placing a secondary mat in said item holder adjacent said item.

20. A trading card display system comprising:

a trading card holder having front and rear panels adapted to hold a trading card therebetween, each of said front and rear panels having at least one transparent area providing for viewing of at least a portion of one side of the trading card therethrough, a frame having front, rear and base panels formed as a unitary item and at least one card viewing region in said front and rear panels for viewing at least a portion of a card therethrough, said trading card holder being attached to a rear surface of said rear panel to provide for viewing of at least a portion of one side of a card through said viewing region, a primary mat adapted for use with said frame, a secondary mat adapted for use with said trading card holder, and means for attaching said trading card holder to a back surface of said frame.

* * * * *